US011035157B2

(12) United States Patent
Cumbo

(10) Patent No.: US 11,035,157 B2
(45) Date of Patent: Jun. 15, 2021

(54) CLOSURE LATCH FOR VEHICLE DOOR HAVING BIDIRECTIONAL POWER RELEASE FUNCTION

(71) Applicant: Magna Closures Inc., Newmarket (CA)

(72) Inventor: Francesco Cumbo, Pisa (IT)

(73) Assignee: MAGNA CLOSURES INC., Newmarket (CA)

( * ) Notice: Subject to any disclaimer, the term of this patent is extended or adjusted under 35 U.S.C. 154(b) by 492 days.

(21) Appl. No.: 15/986,921

(22) Filed: May 23, 2018

(65) Prior Publication Data

US 2018/0340359 A1 Nov. 29, 2018

Related U.S. Application Data

(60) Provisional application No. 62/510,922, filed on May 25, 2017.

(51) Int. Cl.

| | |
|---|---|
| ***E05B 81/80*** | (2014.01) |
| ***E05B 81/16*** | (2014.01) |
| ***E05B 81/44*** | (2014.01) |
| ***E05B 81/30*** | (2014.01) |
| ***E05B 81/82*** | (2014.01) |
| ***E05B 81/86*** | (2014.01) |
| ***E05B 81/42*** | (2014.01) |
| *E05B 81/34* | (2014.01) |
| *E05B 81/06* | (2014.01) |

(52) U.S. Cl.

CPC ..... *E05B 81/80* (2013.01); *E05B 81/16* (2013.01); *E05B 81/30* (2013.01); *E05B 81/42* (2013.01); *E05B 81/44* (2013.01); *E05B 81/82* (2013.01); *E05B 81/86* (2013.01); *E05B 81/06* (2013.01); *E05B 81/34* (2013.01)

(58) Field of Classification Search

CPC ..... E05B 81/06; E05B 81/16; E05B 81/30; E05B 81/34; E05B 81/42; E05B 81/44; E05B 81/14; E05B 81/50; E05B 81/80; E05B 81/86; E05B 81/82; E05B 77/02; Y10T 292/1082

See application file for complete search history.

(56) References Cited

U.S. PATENT DOCUMENTS

| | | | | |
|---|---|---|---|---|
| 5,746,076 | A * | 5/1998 | Inoue | E05B 81/06 70/277 |
| 7,192,066 | B2 | 3/2007 | Ilea et al. | |
| 7,261,334 | B2 * | 8/2007 | Oberheide | E05B 81/14 292/201 |
| 7,791,218 | B2 | 9/2010 | Mekky et al. | |
| 9,546,503 | B2 * | 1/2017 | Krueger | E05C 3/24 |

(Continued)

FOREIGN PATENT DOCUMENTS

| | | | | |
|---|---|---|---|---|
| WO | WO-2006015481 | A1 * | 2/2006 | E05B 81/16 |

*Primary Examiner* — Kristina R Fulton
*Assistant Examiner* — Christopher F Callahan
(74) *Attorney, Agent, or Firm* — Dickinson Wright PLLC

(57) ABSTRACT

The present disclosure relates to a closure latch for a vehicle door, and more particularly to a closure latch for a vehicle door equipped with a passive entry feature. To this end, the present disclosure relates to the use of a bidirectional power release mechanism operable in a first mode to release a latch mechanism under normal operating conditions and which is operable in a second mode to release the latch mechanism under emergency operating conditions.

20 Claims, 7 Drawing Sheets

(56) References Cited

U.S. PATENT DOCUMENTS

| | | | |
|---|---|---|---|
| 9,959,691 | B2 | 5/2018 | Cumbo et al. |
| 2004/0239124 | A1 | 12/2004 | Larsen et al. |
| 2005/0104382 | A1 | 5/2005 | Schupp |
| 2008/0224482 | A1 | 9/2008 | Cumbo et al. |
| 2015/0330116 | A1 | 11/2015 | Dente |
| 2016/0002959 | A1 | 1/2016 | Javadzadeh et al. |
| 2017/0107747 | A1 | 4/2017 | Dente et al. |
| 2018/0044950 | A1 | 2/2018 | Distefano et al. |
| 2018/0163439 | A1 | 6/2018 | Patane et al. |
| 2019/0063117 | A1 | 2/2019 | Mozola |

* cited by examiner

CLOSURE LATCH FOR VEHICLE DOOR HAVING BIDIRECTIONAL POWER RELEASE FUNCTION

CROSS-REFERENCE TO RELATED APPLICATIONS

This application claims the benefit of U.S. Provisional Patent Application No. 62/510,922 filed on May 25, 2017 and titled "Closure Latch for Vehicle Door Having Bidirectional Power Release Function", the entire disclosure of which is hereby incorporated by reference.

FIELD

The present disclosure relates generally to closure latches for a vehicle passenger door. More particularly, the present disclosure is directed to a closure latch equipped with a bidirectional power release mechanism.

BACKGROUND

This section provides background information related to closure latches and is not necessarily prior art to the closure latch of the present disclosure.

Passive entry systems for vehicles are provided on some vehicles to permit a vehicle user who is in possession of the key fob to simply pull the door handle and open the door without the need to introduce a key into a keyhole in the door. The key fob is typically equipped with an electronic device that communicates with the vehicle's on-board control system to authenticate the user. When the user pulls the outside door handle to indicate that he/she wishes entry into the vehicle, an electric actuator associated with a door-mounted closure latch is actuated to release a latch mechanism so as to unlatch the door and permit subsequent movement of the door to its open position. The outside door handle may also be equipped with a switch that triggers the electric actuator. The latch mechanism may also be mechanically released from inside the vehicle since the inside door handle is connected to an inside release mechanism associated with the closure latch. In some jurisdictions, however, there are regulations that govern the degree of connection provided by the inside release mechanism between the inside door handle and the latch mechanism (particularly for a rear door, where children may be the occupants).

Many modern closure latches provide various power-operated features including power release and power lock functionality. Following completion of a power release operation, the power release mechanism within the closure latch must be "reset" to return the associated components from a released state to a home state. This reset function is required to prepare the closure latch for a subsequent closing and relatching of the door.

Typically, the power release mechanism includes a power release cam that is driven by a power release motor in a first or "releasing" direction from a home position into a released position for causing actuation of a latch release mechanism for releasing the latch mechanism. Thereafter, the power release motor drives the power release cam in a second or "resetting" direction for returning the power release cam to its home position. Reversing operation of the power release motor is known to generate noise during the resetting operation which is considered to be undesirable. Another issue with "powered" resetting of the power release mechanism is the potential inability to subsequently release the latch mechanism in the event of a power loss from the primary power source (i.e. the vehicle battery) and the closure latch's backup power source (i.e. the supercapacitors). This potential situation is particularly problematic in closure latches not equipped with a mechanical inside latch release mechanism since the vehicle occupant may be unable to release the latch mechanism and escape from the vehicle.

In view of the above, a recognized need exists to address current shortcomings associated with power release closure latches and provide solutions that advance the art and still meet all safety and regulatory requirements, such as a power release mechanism configured to provide a non-powered reset function under normal operating conditions and a powered reset function under emergency operating conditions.

SUMMARY

This section provides a general summary of the disclosure and is not intended to be considered as a comprehensive and exhaustive listing of its full scope or all of its aspects, features and objectives.

It is an aspect of the present disclosure to provide a closure latch for a vehicle having a latch mechanism, a latch release mechanism, and a power release mechanism for controlling powered actuation of the latch release mechanism to provide a power releasing function. The power release mechanism is also configured to provide a non-powered reset function under normal operating conditions and a powered reset function under emergency operating conditions.

It is a related aspect of the present disclosure to configure the power release mechanism to include a power release motor, a power release gear driven by the power release motor, and a return spring biasing the power release gear to a neutral/home position. Rotation of the power release gear in a first or "normal releasing" direction from the neutral/home position to a first released position causes a power release cam to actuate the latch release mechanism. Thereafter, the return spring drives the power release gear from its first released position back to its neutral/home position without powering (i.e. via mechanical backdriving) the power release motor so as to provide the non-powered reset function. Rotation of the power release gear in a second or "emergency releasing" direction from the neutral/home position to a second released position causes an emergency release cam to actuate the latch release mechanism. The return spring is not configured to mechanically return the power release gear from its second released position back to its neutral/home position such that the power release gear remains in its second released position. As such, the reset function is subsequently provided manually (manual reset) or by actuating the power release motor to drive the power release gear from its second released position to its neutral/home position. The power release motor is operable to drive the power release gear in the first releasing direction when a control unit indicates that power is supplied to the closure latch from the primary power source, thereby defining a "normal" release mode of operation. In contrast, the power release motor is operable to drive the power release gear in the second releasing direction when the control unit indicates that no power is available from the primary power source, thereby defining an "emergency" release mode of operation.

It is another related aspect of the present disclosure that the power release mechanism includes a bidirectional power release functionality.

In accordance with these and other aspects, the present disclosure is directed to a closure latch for a vehicle door. The closure latch comprises: a latch mechanism including a ratchet and a pawl, the ratchet being moveable between a striker capture position and a striker release position, the pawl being moveable between a ratchet holding position whereat the pawl holds the ratchet in its striker capture position and a ratchet releasing position whereat the pawl permits the ratchet to move to its striker release position; and a power release mechanism having an actuator release lever operatively connected to the pawl and a power release actuator, the actuator release lever being moveable between a non-actuated position whereat the pawl is maintained in its ratchet holding position and an actuated position whereat the actuator release lever moves the pawl to its ratchet releasing position, the power release actuator including a power release gear having a power release cam and an emergency release cam, a power release motor operable in a first mode to rotate the power release gear in a first releasing direction from a neutral/home position to a first released position for causing the power release cam to move the actuator release lever from its non-actuated position to its actuated position and is operable in a second mode to rotate the power release gear in a second releasing direction from its neutral/home position to a second released position for causing the emergency release cam to move the actuator release lever from its non-actuated position to its actuated position, and a return spring for driving the power release gear from its first released position back to its neutral/home position to define a mechanical, non-powered reset function.

Further areas of applicability will become apparent from the description provided herein. The description and specific embodiments listed in this summary are for purposes of illustration only and are not intended to limit the scope of the present disclosure.

BRIEF DESCRIPTION OF THE DRAWINGS

The drawings described herein have been provided to illustrate selected embodiments and specific features thereof and are not intended to limit the scope of the present disclosure. The present disclosure will now be described by way of example only with reference to the attached drawings, in which.

DETAILED DESCRIPTION

An example embodiment of a closure latch for use in motor vehicle door closure systems is provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
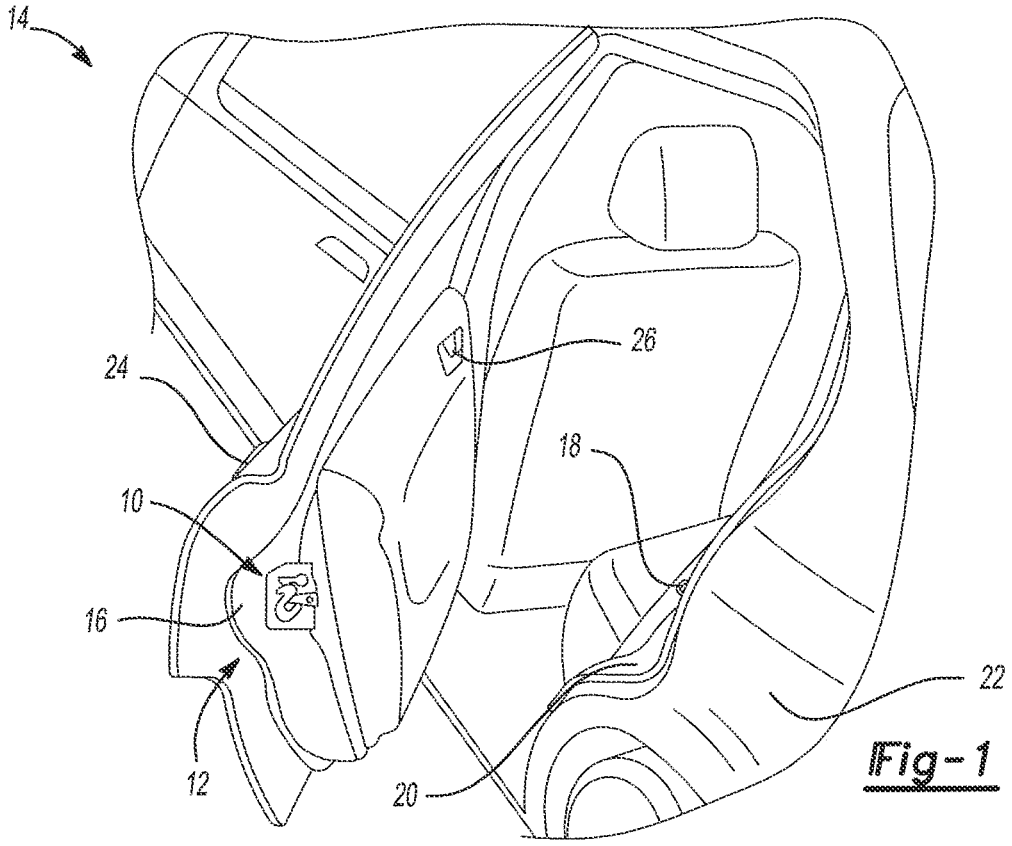
FIG. 1 is a perspective view of a motor vehicle with a passenger door that is equipped with a closure latch embodying the teaching of the present disclosure.

Referring initially to FIG. 1, a closure latch 10 for a passenger door 12 of a motor vehicle 14 is shown positioned along a rear edge portion 16 of door 12 and is configured to releaseably engage a striker 18 secured in a door opening 20 formed in the vehicle's body 22 in response to movement of door 12 from an open position (shown) to a closed position. Door 12 includes an external or outside door handle 24 and an internal or inside door handle 26, both of which are operatively coupled (i.e. electrically and/or mechanically) to closure latch 10.

Figure 2:
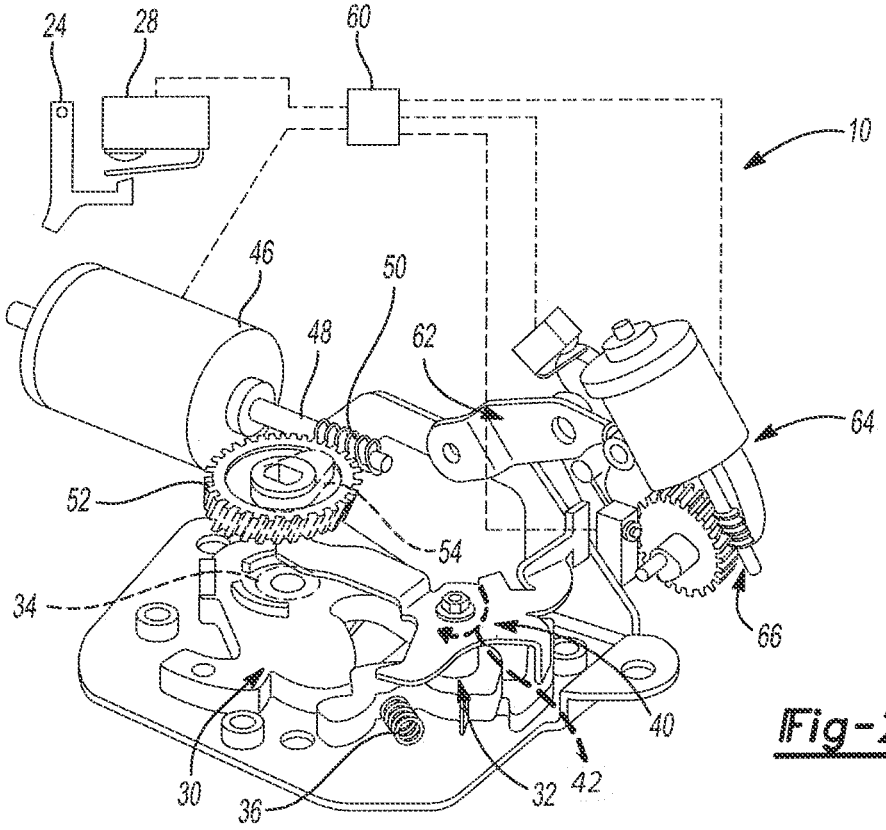
FIG. 2 is an isometric view of a closure latch equipped with a latch mechanism and a power release mechanism.

Referring now to FIG. 2, a non-limiting embodiment of closure latch assembly 10 is shown to generally include a latch mechanism, a latch release mechanism, a power release mechanism, and a power lock mechanism. The latch mechanism includes a ratchet 30 and a pawl 32. Ratchet 30 is moveable between a first or "striker capture" position whereat the ratchet 30 retains the striker 18 and a second or "striker release" position whereat the ratchet 30 permits release of the striker 18. A ratchet biasing member, such as a torsion spring 34, biases ratchet 30 toward its striker release position. The pawl 32 is pivotably moveable relative to ratchet 30 between a first or "ratchet holding" position whereat the pawl 32 holds the ratchet 30 in its striker capture and a second or "ratchet releasing" position whereat the pawl 32 permits the ratchet 30 to move to its striker release position. A pawl biasing member, such as a coil spring 36, biases pawl 32 toward its ratchet holding position.

The latch release mechanism includes, among other things, a pawl release lever 40 operatively connected to pawl 32 and which is movable between a first or "pawl release" position whereat the pawl release lever 40 causes the pawl 32 to move from the ratchet holding position to the ratchet releasing position and a second or "home" position whereat pawl release lever 40 permits pawl 32 to be maintained in the ratchet holding position. A pawl release lever biasing member, such as a suitable pawl release lever spring 42, is provided to bias pawl release lever 40 to its home position. Pawl release lever 40 may be moved from its home position to its pawl release position by several components such as, for example, the power release mechanism.

The power release mechanism includes, among other things, a power release electric motor 46 having a rotatable motor output shaft 48, a power release worm gear 50 secured for rotation with the motor output shaft 48, a power release gear 52, and a power release cam 54. Power release cam 54 is connected for common rotation with power release gear 52 and is rotatable between a first or "pawl release" range of positions and a second or "pawl non-release" range of positions. Power release gear 52 is driven by worm gear 50 in response to actuation of power release motor 46 and, in turn, drives power release cam 54 which controls the pivoting movement of pawl release lever 40 between its home and pawl release positions.

The power release mechanism may be used as part of a passive entry feature. When a person approaches vehicle 14 with an electronic key fob and opens outside door handle 24, an electronic latch release system associated with vehicle 14 senses both the presence of the key fob and that outside door handle 24 has been actuated (e.g. via communication between a switch 28 and an electronic control unit (ECU) shown at 60 that at least partially controls the operation of closure latch 10). In turn, ECU 60 actuates the power release mechanism to release the latch mechanism and unlatch closure latch 10 so as to open the vehicle door.

The power lock mechanism controls the operative connection between an inside release lever 62 associated with the inside door release mechanism and pawl release lever 40. The power lock mechanism includes, among other things, a power lock actuator 64 and a lock mechanism 66.

Figure 3:
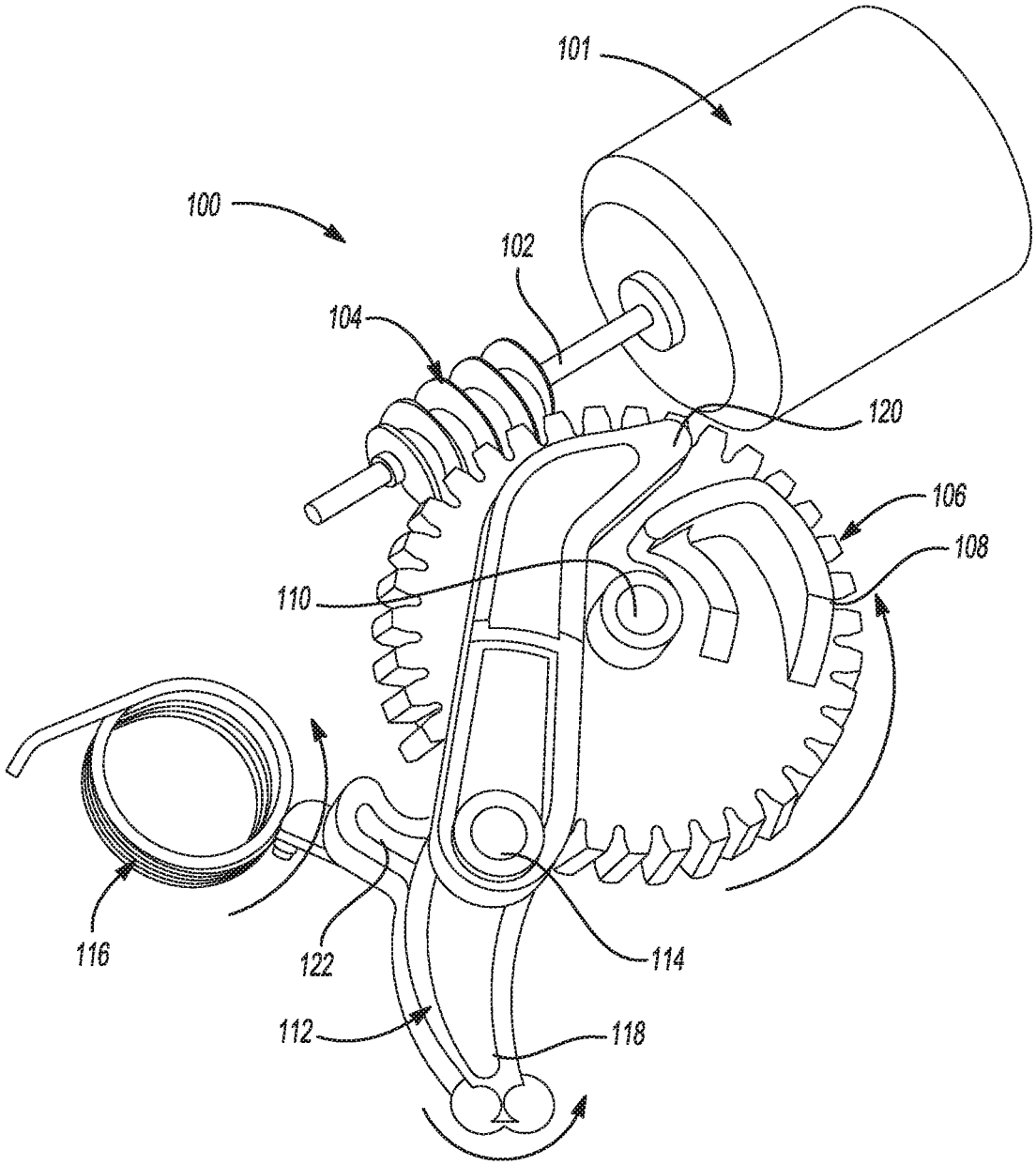
FIG. 3 is an isometric view showing the components of the power release mechanism associated with the closure latch shown in FIG. 2.

Referring now to FIG. 3, the components associated with a non-limiting embodiment of a power release mechanism 100 adapted for use with closure latch 10 are shown to include a power release actuator having a power release motor 101 with a motor shaft 102 driving a worm gear 104, and a power release gear 106 having a release cam 108 formed thereon. Power release gear 106 is rotatable about a post 110 in a first or "releasing" (i.e. counterclockwise) direction and a second or "resetting" (i.e. clockwise) direction via actuation of power release motor 101. Power release gear 106 is rotatable about post 110 between a "home" position (shown) and a "released" position for causing pivotal movement of an actuator release lever 112 from a first or "non-actuated" position (shown) into a second or "actuated" position. Actuator release lever 112 is supported for pivotal movement relative to a pivot post 114 and is normally biased toward its non-actuated position by an actuator lever spring 116. Actuator lever 112 is operable in its non-actuated position to disengage its first leg segment 118 from pawl release lever 40, when located in its home position, so as to permit pawl 32 to remain in its ratchet holding position. In contrast, movement of actuator lever 112 to its actuated position causes its first leg segment 118 to forcibly engage and pivot pawl release lever 40 from its home position to its pawl release position, thereby causing pawl 32 to move from its ratchet holding position to its ratchet releasing position. A second leg segment 120 of actuator release lever 112 is engageable with release cam 108 due to the biasing of actuator lever spring 116. As such, rotation of power release gear 106 in its releasing direction from its home position to its released position causes corresponding pivotal movement of actuator release lever 112 from its non-actuated position into its actuated position. Likewise, rotation of power release gear 106 in its resetting direction from its released position to its home position results in corresponding pivotal movement of actuator release lever 112 from its actuated position to its non-actuated position.

Figure 4:
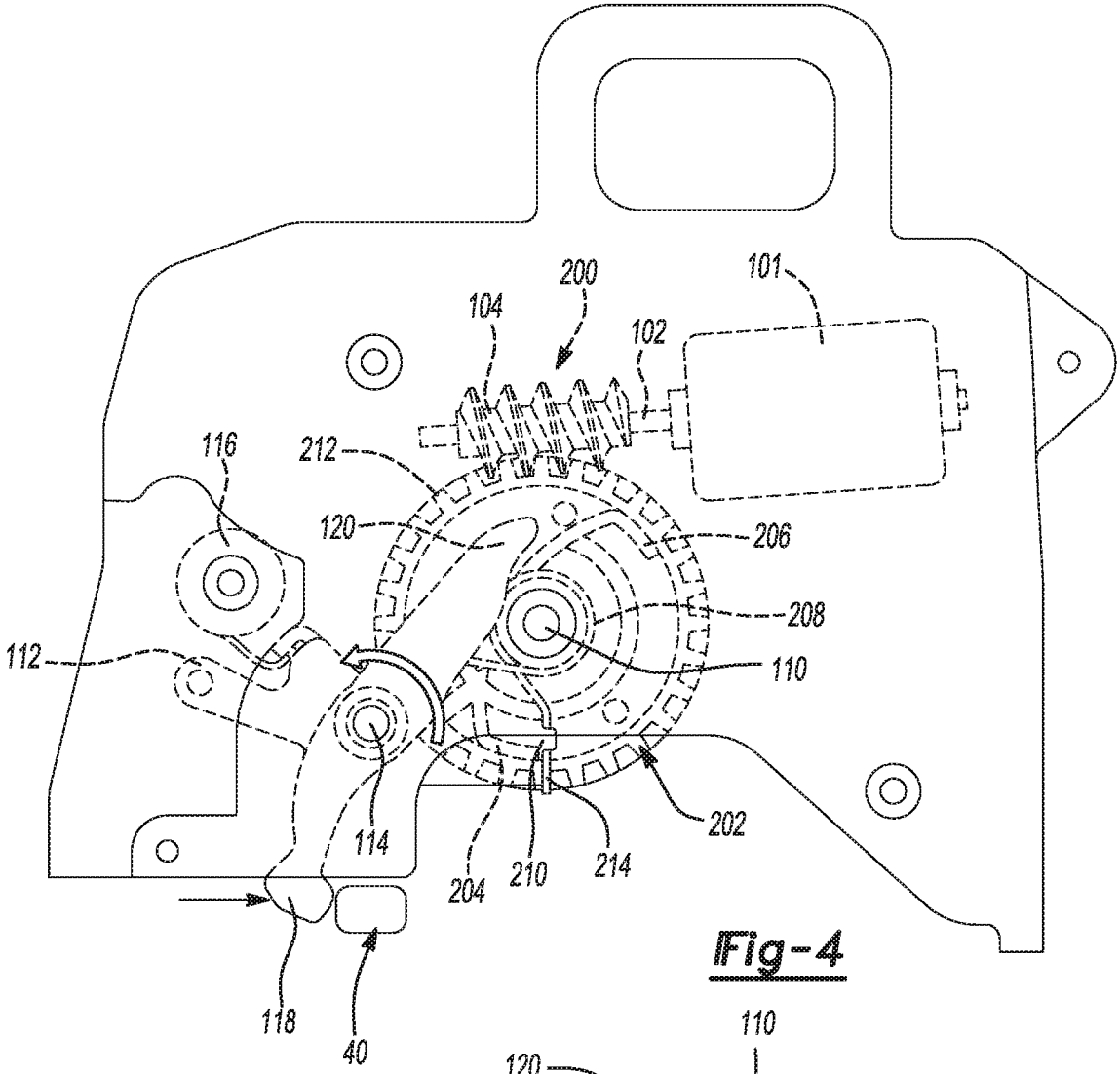
FIG. 4 is a plan view of the components associated with an alternative configuration of a bidirectional power release mechanism associated with the closure latch of the present disclosure.
Figure 5:
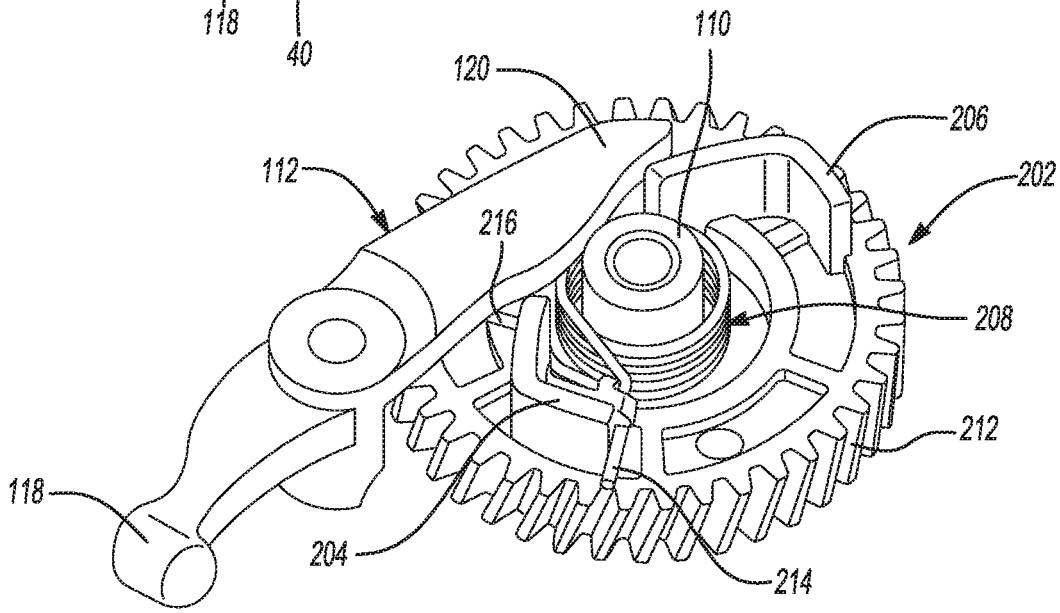
FIG. 5 is an isometric view of various components associated with the power release mechanism shown in FIG. 4.

Referring now to FIG. 4, a power release mechanism 200 is shown which is generally a modified version of power release mechanism 100 (FIG. 3) and includes many similar components identified hereinafter and in the drawings using common reference numerals. Power release mechanism 200 is configured to provide a bi-directional releasing function, with each directional releasing operation associated with a distinct operating mode for closure latch 10. As seen, power release mechanism 200 includes power release motor 101 with its motor shaft 102 driving worm gear 104, a power release gear 202 having a power release cam 204 and an emergency release cam 206, and a return spring 208 acting between power release gear 202 and a latch housing 210. Power release gear 202 has gear teeth 212 meshed with worm gear 104 such that rotation of motor output shaft 102 in a first direction causing corresponding rotation of power release gear 202 in a first (i.e. clockwise) direction and rotation of motor output shaft 102 in a second direction causes corresponding rotation of power release gear 202 in a second (i.e. counterclockwise) direction.

Power release gear 202 is shown in FIGS. 4, 5, 6A and 7A located in a neutral/home position with actuator release lever 112 located in its non-actuated position such that pawl release lever 40 is located in its home position with pawl 32 located in its ratchet holding position, thereby maintaining ratchet 30 in its striker capture position for establishing the latched mode of closure latch 10. In its neutral/home position, power release gear 202 is positioned such that neither of power release cam 204 and emergency release cam 206 are acting on actuation leg segment 120 of actuator release lever 112.

Figure 6B:
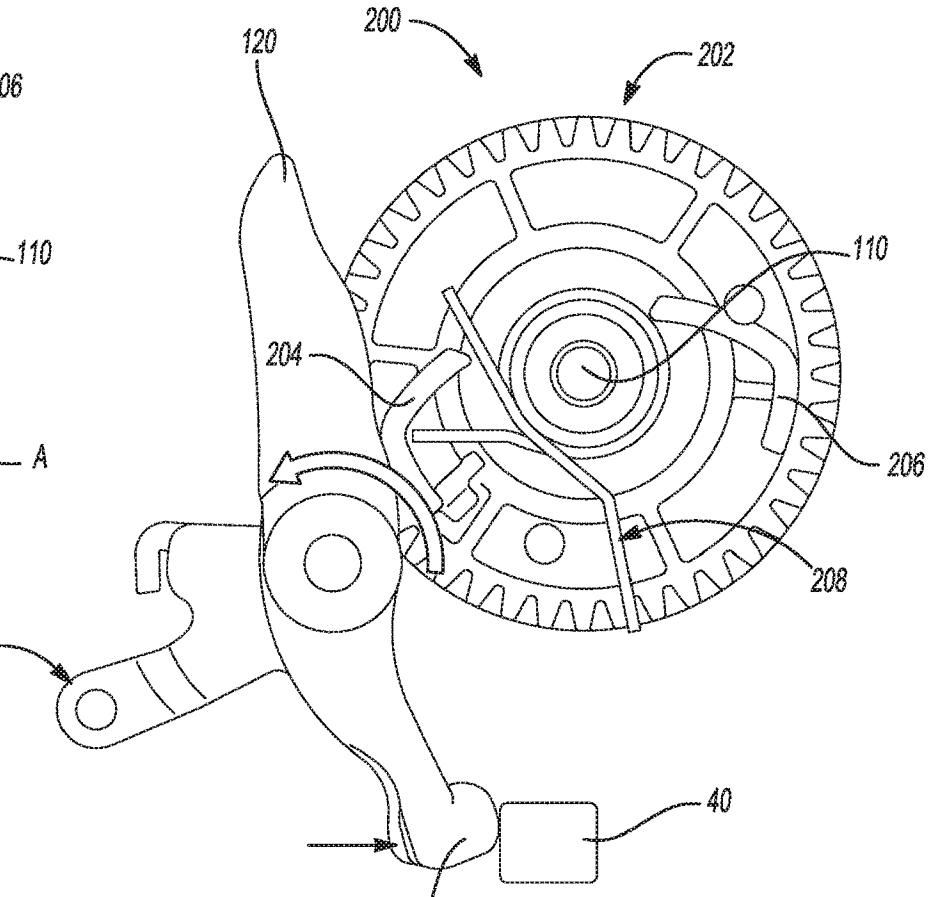
FIG. 6B illustrates the power release gear rotated in a first or "normal" releasing direction from the neutral/home position to a first released position when the closure latch is operating in a normal mode.
Figure 6A:
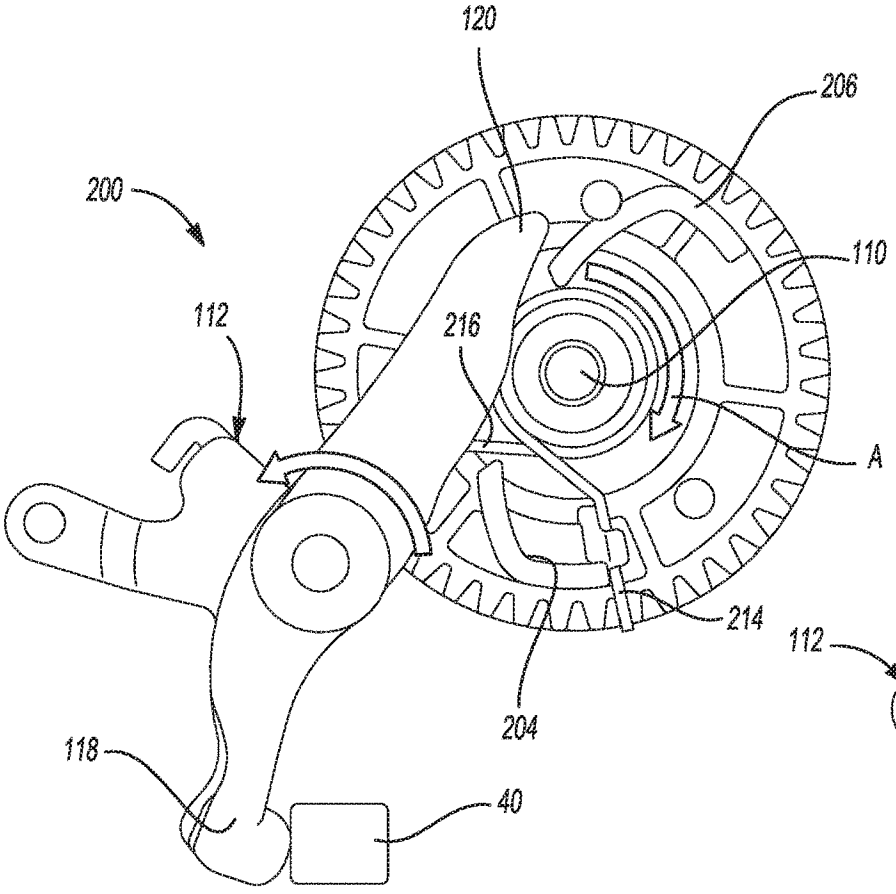
FIG. 6A illustrates a power release gear associated with the power release mechanism shown in FIGS. 4 and 5 located in a neutral/home position.

When control unit 60 indicates that closure latch 10 is supplied with electrical power from the vehicle's primary power source (i.e. the battery), power release mechanism 200 is considered to be operating in a "normal release" mode. As such, when a signal is provided to release closure latch 10, power release motor 101 is energized to rotate power release gear 202 in a first releasing direction (i.e. clockwise), as indicated by arrow "A", from its neutral/home position (FIG. 6A) to a first released position (FIG. 6B). Such rotation of power release gear 202 causes power release cam 204 to engage actuator leg segment 120 of actuator release lever 112 and forcibly pivot actuator release lever 112, in opposition to the biasing of spring 116, from its non-actuated position to its actuated position for causing pawl 32 to move to its ratchet releasing position, thereby releasing ratchet 30 for movement to its striker release position. However, such rotation of power release gear 202 causes return spring 208 to be compressed (i.e. loaded) since its first end segment 214 is secured to power release gear 202 and its second end segment 216 engages a stationary portion of housing 210. Upon release of the latch mechanism, a non-powered resetting function is completed. Specifically, power release motor 101 is turned off and return spring 208 backdrives power release gear 202 from its first released position (FIG. 6B) to its neutral/home position (FIG. 6A) which, in turn, backdrives motor shaft 102 and electric motor 101. Since power release gear 202 is mechanically reset during operation of closure latch 10 in its normal operating mode, no noise is generated as is typically associated with powered resetting of the power release mechanism.

Figure 7B:
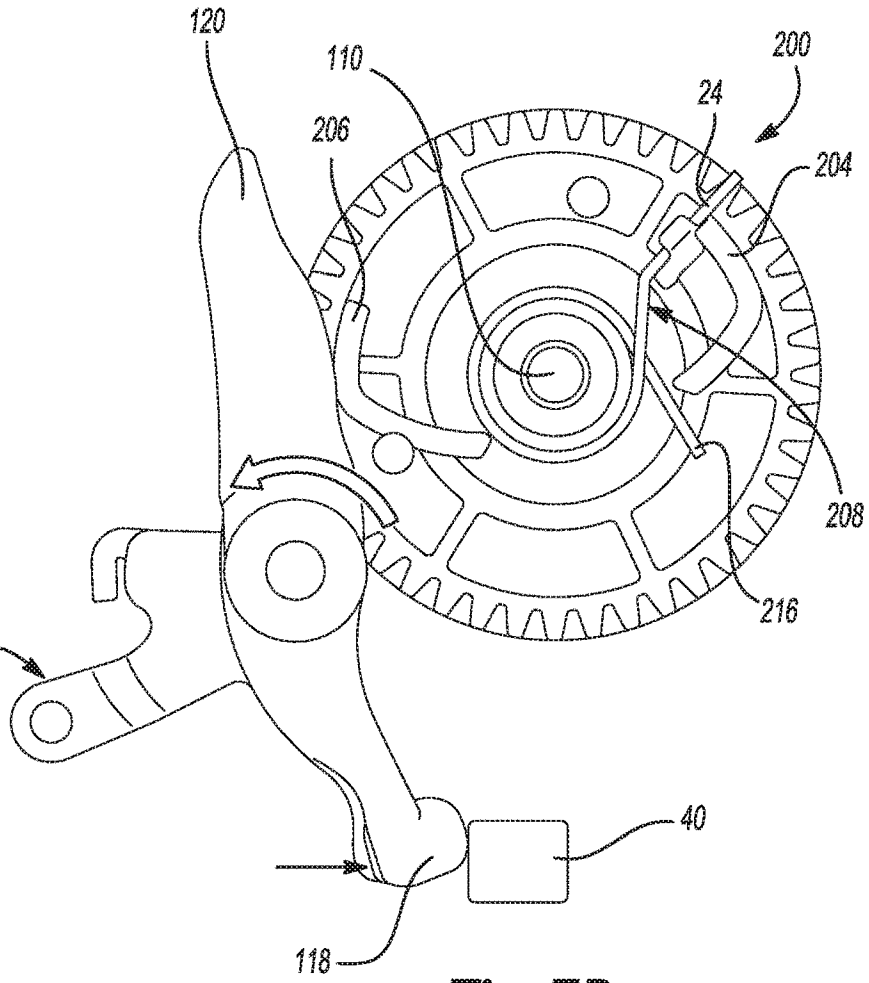
FIG. 7A illustrates the power release gear located in its neutral/home position and FIG. 7B illustrates rotation of the power release gear in a second or "emergency" releasing direction from the neutral/home position to a second released position when the closure latch is operating in an emergency mode.
Figure 7A:
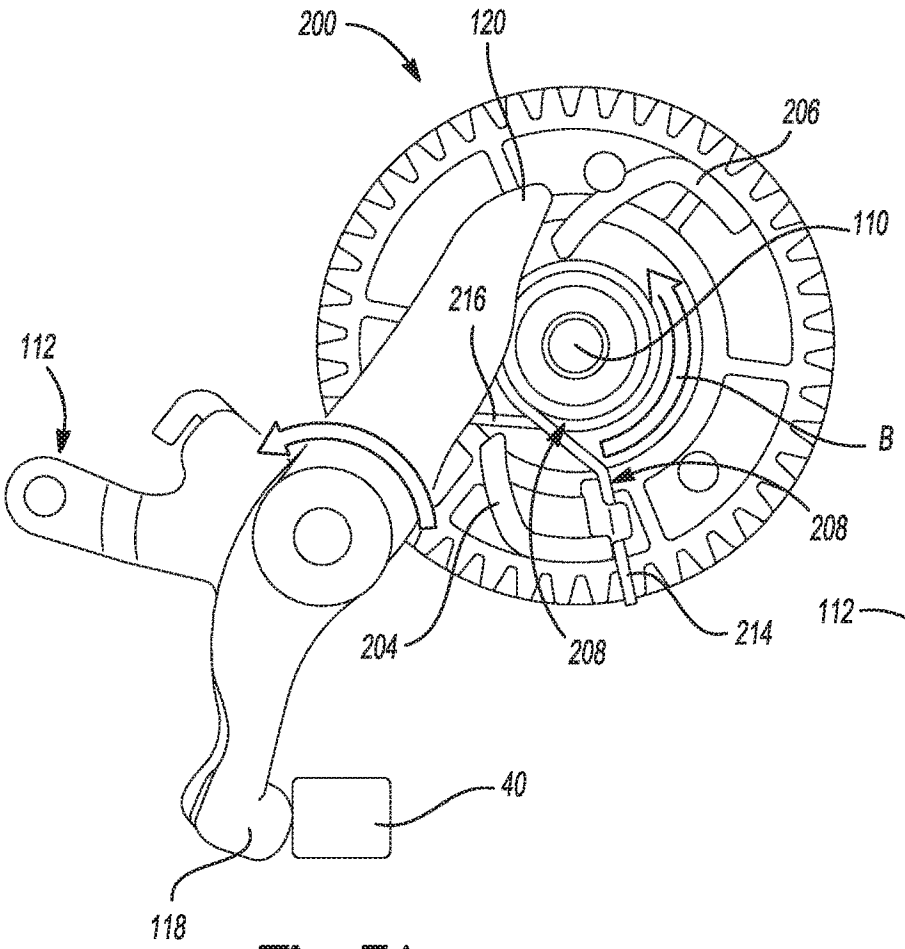

When control unit 60 indicates that closure latch 10 is not supplied with electrical power from the vehicle's primary power source and may be relying on a backup power source (i.e. supercapacitors), power release mechanism 200 is considered to be operating in an "emergency release" mode. As such, when a signal is provided to release closure latch 10, power release motor 101 is energized to rotate power release gear 202 in a second releasing direction (i.e. counterclockwise), as indicated by arrow "B", from its neutral/home position (FIG. 7A) to a second released position (FIG. 7B). Such rotation of power release gear 202 causes emergency release cam 206 to engage actuation leg segment 120 and forcibly pivot actuator release lever 112, in opposition to the biasing of spring 116, from its non-actuated position into its actuated position for causing pawl 32 to move to its ratchet releasing position, thereby releasing ratchet 30 for movement to its striker release position. However, such rotation of power release gear 202 in the second releasing direction does not act to cause return spring 208 to be loaded since its second end segment 216 is no longer engaged with a stationary component of latch housing 210. Thus, power release gear 202 is held in its second released position. Subsequent resetting of power release mechanism 200, required for moving power release gear 202 from its second released position back to its neutral/home position, is completed either manually (if no power) or electrically (via backup power) by driving power release motor 101 in the opposite direction.

Figure 8:
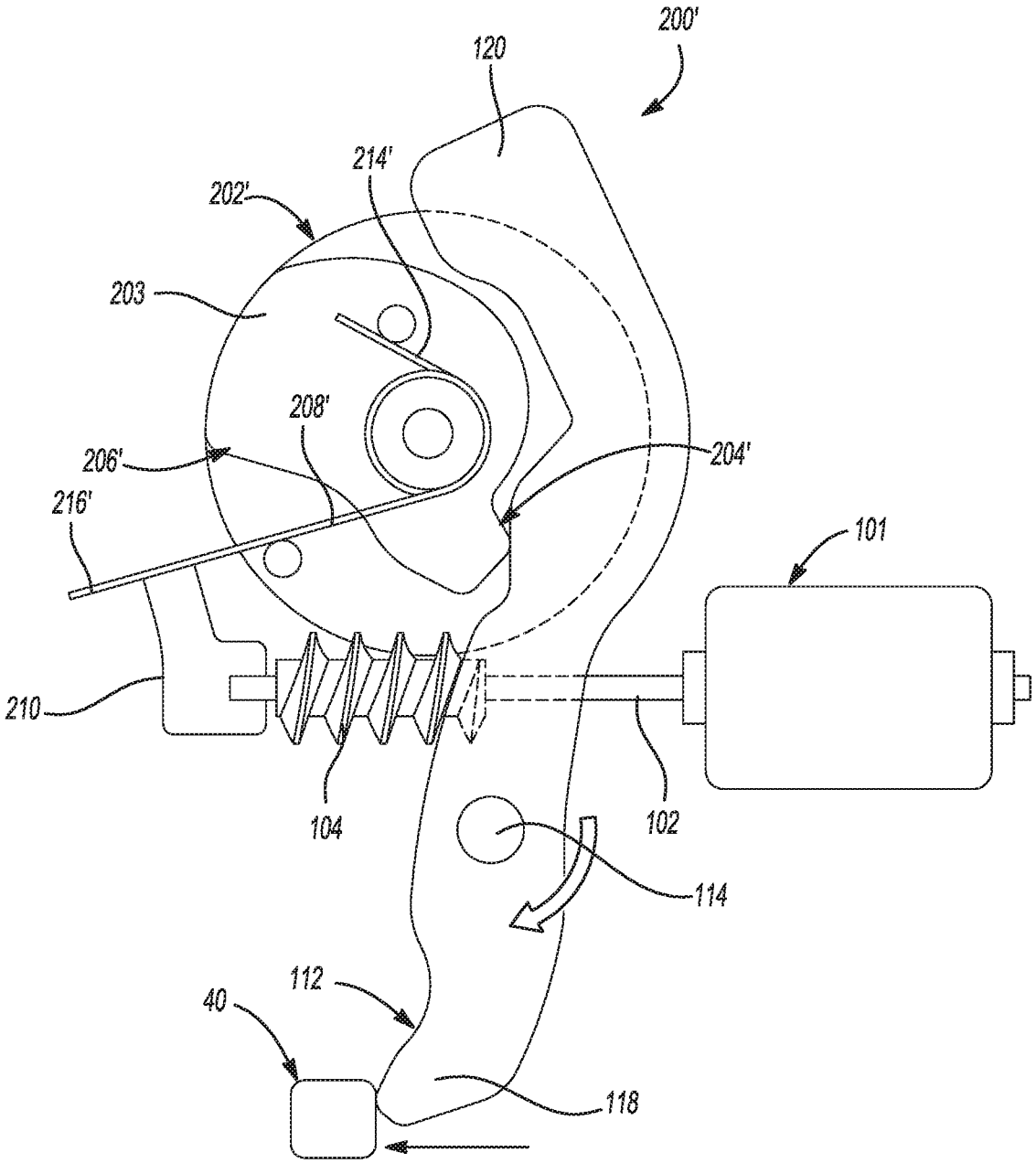
FIG. 8 is a sketch of another version of a bidirectional power release mechanism of the present disclosure with the power release gear shown in its neutral/home position.
Figure 10:
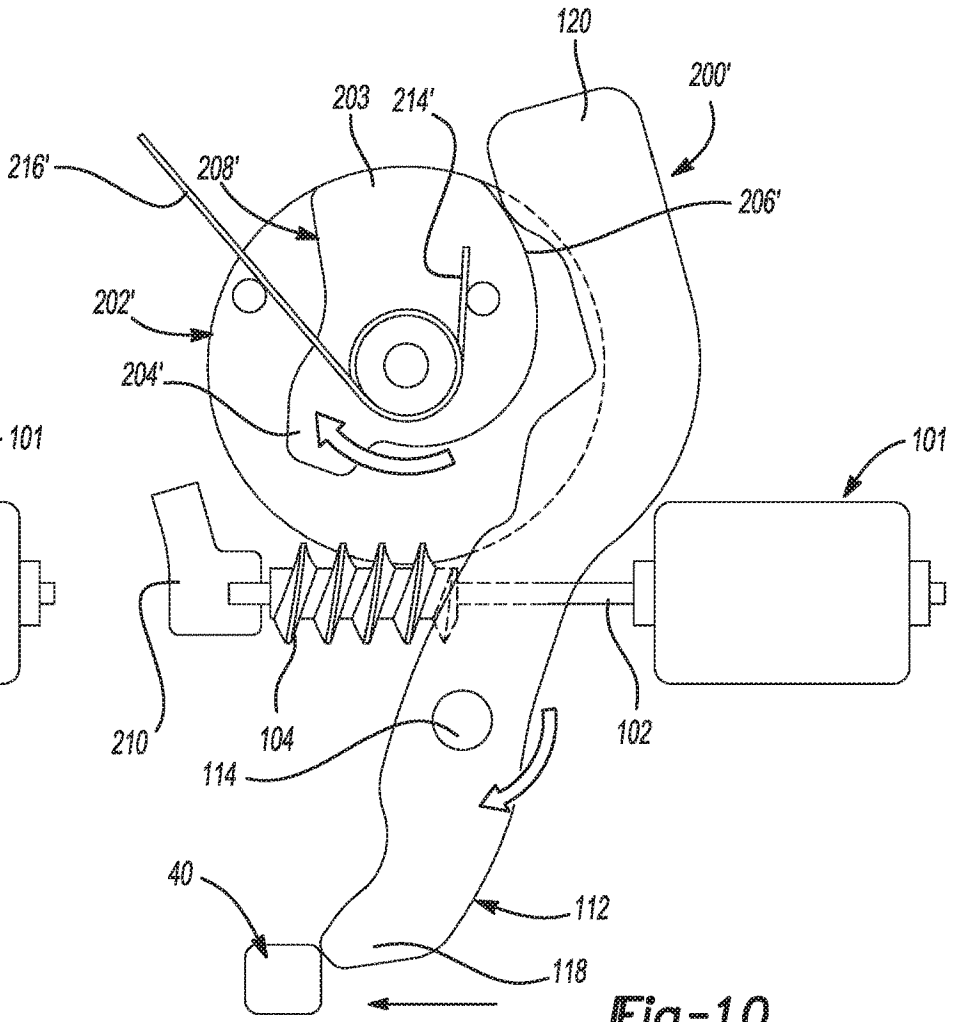
FIG. 10 shows the power release gear rotated from its neutral/home position to its second released position.
Figure 9:
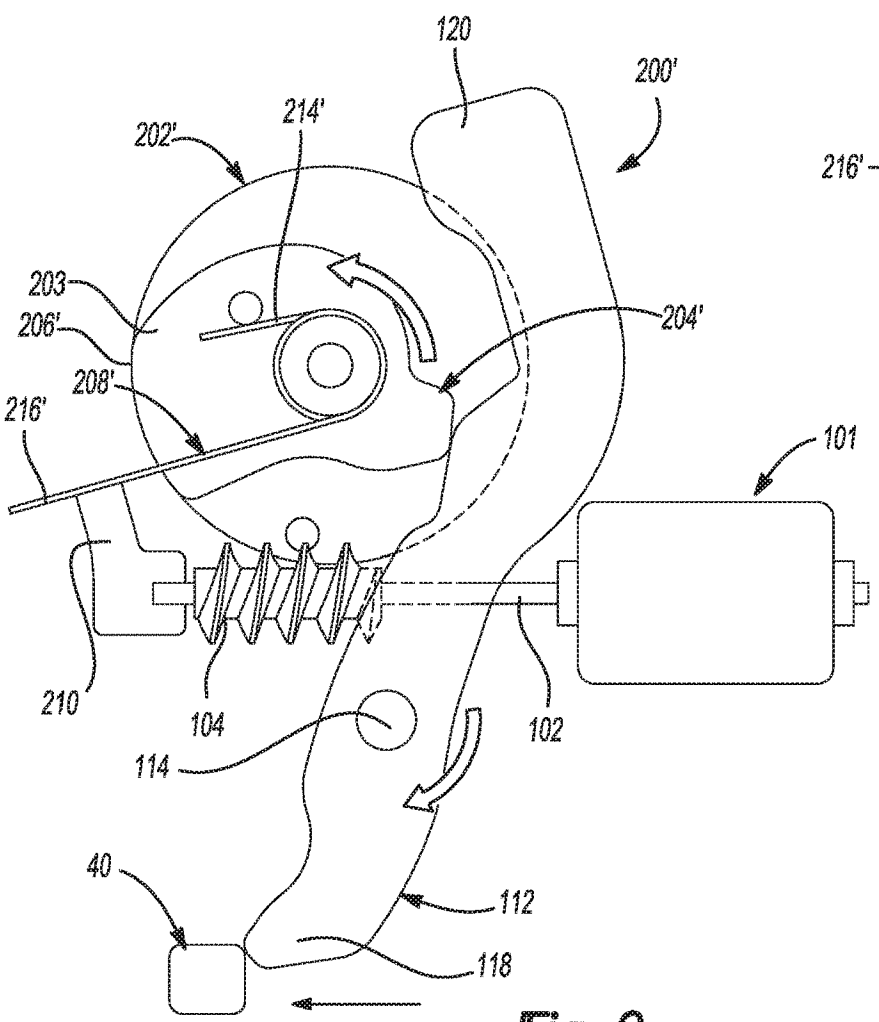
FIG. 9 is similar to FIG. 8 except that the power release gear is shown rotated from its neutral/home position to its first released position for providing a spring-loaded resetting function.

Referring now to FIGS. 8-10, a modified version of power release mechanism 200 is shown as power release mechanism 200' and is generally identical thereto with the exception that power release gear 202' has a common cam 203 defining both a power release cam segment 204' and an emergency release cam segment 206'. In other words, a single integral common cam is provided that defines both the power release cam and the emergency release cam. Otherwise, the functionality and operation of power release mechanism 200' is substantially similar to that of power release mechanism 200.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A closure latch for a vehicle door, comprising:

a latch mechanism including a ratchet and a pawl, the ratchet being moveable between a striker capture position and a striker release position, the pawl being moveable between a ratchet holding position whereat the pawl holds the ratchet in its striker capture position and a ratchet releasing position whereat the pawl permits the ratchet to move to its striker release position; and a power release mechanism having an actuator release lever operatively connected to the pawl and a power release actuator, the actuator release lever being moveable between a non-actuated position whereat the pawl is maintained in its ratchet holding position and an actuated position whereat the actuator release lever moves the pawl to its ratchet releasing position, the power release actuator being operable to move the actuator release lever from its non-actuated position to its actuated position and including a power release motor, a power release gear driven by the power release motor, and a return spring, wherein the power release gear includes a power release cam and an emergency release cam and is moveable in a first releasing direction from a neutral/home position to a first released position for causing the power release cam to move the actuator release lever from its non-actuated position to its actuated position wherein the power release gear is also moveable in a second releasing direction from its neutral/home position to a second released position for causing the emergency release cam to move the actuator release lever from its non-actuated position to its actuated position, and wherein the return spring is loaded in response to movement of the power release gear from its neutral/home position to its first releasing position and operates to subsequently rotate the power release gear from its first released position to its neutral/home position to provide a non-powered resetting function.

2. The closure latch of claim 1, wherein the power release mechanism further includes an actuator lever biasing member for biasing the actuator release lever toward its non-actuated position, and wherein the latch mechanism further includes a ratchet biasing member for biasing the ratchet toward its striker release position and a pawl biasing member for biasing the pawl toward its ratchet holding position.

3. The closure latch of claim 1, wherein the return spring has a first end segment coupled to the power release gear and a second end segment selectively engageable with a stationary component in response to rotation of the power release gear in the first releasing direction from its neutral/home position toward its first released position, and wherein the power release motor is deenergized when the power release gear is located in its first released position to permit the return spring to forcibly rotate the power release gear back to its neutral/home position to define the non-powered resetting function.

4. The closure latch of claim 1, wherein each of the power release cam and the emergency release cam are integrally formed in the power release gear, and wherein teeth of the power release gear are meshed with a worm gear driven by the power release motor.

5. The closure latch of claim 1, wherein the power release mechanism operates in a normal release mode when electrical power is supplied to the closure latch from a primary power source such that the power release motor operates to move the power release gear in the first releasing direction from its neutral/home position to its first released position.

6. The closure latch of claim 5, wherein the power release mechanism operates in an emergency release mode when electrical power is not supplied to the closure latch from the primary power source such that the power release motor is driven by a backup power source to move the power release gear in the second releasing direction from its neutral/home position to its second released position.

7. The closure latch of claim 6, wherein in the emergency release mode, the backup power supply powers the power release motor to drive the power release gear in a resetting direction from its second released position back to its neutral/home position.

8. The closure latch of claim 1 further including a pawl release lever operatively connected to the pawl and moveable between a pawl release position whereat the pawl release lever causes the pawl to move from the ratchet holding position to the ratchet releasing position and a home position whereat the pawl release lever permits the pawl to be maintained in the ratchet holding position.

9. The closure latch of claim 1 wherein a single integral common cam has a power release cam segment defining the power release cam and an emergency release cam segment defining the emergency release cam.

10. The closure latch of claim 1 wherein the actuator lever includes a first leg segment and a second leg segment, and wherein the first leg segment is configured to engage the pawl release lever when the pawl release member is in the home position to permit the pawl to remain in the ratchet holding position, and wherein movement of actuator lever to the actuated position causes the first leg segment to forcibly engage and pivot the pawl release lever from its home position to its pawl release position, thereby causing the pawl to move from its ratchet holding position to its ratchet release position, and wherein the second leg segment is engageable with the release cam due to biasing by an actuator lever biasing member.

11. The closure latch of claim 1 wherein the power release cam and the emergency release cam are circumferentially spaced from one another.

12. The closure latch of claim 1 wherein the actuator release lever is supported for pivotal movement relative to a pivot post.

13. A closure latch for a vehicle door, comprising:

a latch mechanism including a ratchet and a pawl, the ratchet being moveable between a striker capture position and a striker release position, the pawl being moveable between a ratchet holding position whereat the pawl holds the ratchet in its striker capture position and a ratchet releasing position whereat the pawl permits the ratchet to move to its striker release position;

a power release mechanism having an actuator release lever operatively connected to the pawl and moveable between a non-actuated position whereat the pawl is maintained in its ratchet holding position and an actuated position whereat the actuator release lever moves the pawl to its ratchet releasing position, the power release mechanism further including a power release actuator coupled with the actuator release lever and operable to move the actuator release lever from its non-actuated position to its actuated position, the power release actuator including a power release motor, a power release gear driven by the power release motor, and a return spring;

the power release gear including a power release cam and an emergency release cam, and the power release gear being rotatable in a first releasing direction from a neutral/home position to a first released position for causing the power release cam to move the actuator release lever from the non-actuated position to the actuated position, and the power release gear being rotatable in a second releasing direction from the neutral/home position to a second released position for causing the emergency release cam to move the actuator release lever from the non-actuated position to the actuated position;

wherein the return spring is coupled with the power release gear and loaded in response to movement of the power release gear from the neutral/home position to the first releasing position and operates to subsequently rotate the power release gear from the first released position to the neutral/home position to provide a non-powered resetting function; a control unit configured to determine whether the closure latch is being supplied power from a primary power source or a backup power source, and wherein the control unit is configured to rotate the power release gear in the first releasing direction for causing the power release cam to move the actuator release lever from its non-actuated position to its actuated position when it is determined that the closure latch is being supplied power from the primary power source, and wherein the control unit is configured to rotate the power release gear in the second released position for causing the emergency release cam to move the actuator release lever from its non-actuated position to its actuated position when it is determined that closure latch is being supplied power from the backup power source.

14. The closure latch of claim 13 wherein the power release mechanism further includes an actuator lever biasing member for biasing the actuator lever toward its non-actuated position, and wherein the latch mechanism further includes a ratchet biasing member for biasing the ratchet toward its striker release positon and a pawl biasing member for biasing the pawl toward its ratchet holding position.

15. The closure latch of claim 13 wherein the return spring has a first end segment coupled to the power release gear and a second end segment selectively engageable with a stationary component in response to rotation of the power release gear in the first releasing direction from its neutral/home position toward its first released position, and wherein the power release motor is deenergized when the power release gear is located in its first released position to permit the return spring to forcibly rotate the power release gear back to its neutral/home position to define the non-powered resetting function.

16. The closure latch of claim 13 wherein each of the power release cam and the emergency release cam are integrally formed in the power release gear, and wherein teeth of the power release gear are meshed with a worm gear driven by the power release motor.

17. The closure latch of claim 13 further including a pawl release lever operatively connected to the pawl and moveable between a pawl release position whereat the pawl release lever causes the pawl to move from the ratchet holding position to the ratchet releasing position and a home position whereat the pawl release lever permits the pawl to be maintained in the ratchet holding position.

18. The closure latch of claim 13 wherein a single integral common cam has a power release cam segment defining the power release cam and an emergency release cam segment defining the emergency release cam.

19. The closure latch of claim 13 wherein the actuator lever includes a first leg segment and a second leg segment, and wherein the first leg segment is configured to engage the pawl release lever when the pawl release member is in the home position to permit the pawl to remain in the ratchet holding position, and wherein movement of the actuator lever to the actuated position causes the first leg to forcibly engage and pivot the pawl release lever from its home position to its pawl release position, thereby causing the pawl to move from its ratchet holding position to its ratchet release position, and wherein the second leg segment is engageable with the release cam due to biasing by an actuator lever biasing member.

20. The closure latch of claim 13 wherein the power release cam and the emergency release cam are circumferentially spaced from one another.

* * * * *